United States Patent [19]

Wilson et al.

[11] Patent Number: 4,951,564

[45] Date of Patent: Aug. 28, 1990

[54] PIGGYBACK RECORDER FOR ADDING SECOND RECORDER TO A PRINTER TERMINAL

[75] Inventors: Hillis L. Wilson; Peter W. Yaichuk, both of Groton; Michael B. Davenport, Ithaca; Jack W. Stare, Dryden; Thomas J. Bossack, Candor, all of N.Y.

[73] Assignee: NCR Corporation, Dayton, Ohio

[21] Appl. No.: 456,412

[22] Filed: Dec. 26, 1989

[51] Int. Cl.[5] ..... B41J 3/50

[52] U.S. Cl. ..... 101/93.12; 400/124; 400/82; 346/44; 346/50

[58] Field of Search ..... 101/93.12, 93.11, 93.05; 400/124, 82, 104, 141, 149; 346/44, 49, 50

[56] References Cited

U.S. PATENT DOCUMENTS

| | | | |
|---|---|---|---|
| 3,960,080 | 6/1976 | Adahan . | |
| 4,030,590 | 6/1977 | Wojdyla | 400/82 |
| 4,149,458 | 4/1979 | Clary . | |
| 4,204,779 | 5/1980 | Lee et al. | 400/82 |
| 4,348,125 | 9/1982 | Fujiwara et al. . | |
| 4,389,126 | 6/1983 | Honma et al. | 400/82 |
| 4,444,519 | 4/1984 | Howell et al. | 400/82 |
| 4,455,937 | 6/1984 | Murata et al. | 400/82 |
| 4,576,490 | 3/1986 | Isobe | 400/149 |
| 4,595,303 | 6/1986 | Kuzuya et al. | 400/82 |
| 4,684,269 | 8/1987 | Miw | 400/82 |
| 4,692,041 | 9/1987 | Dyma et al. | 400/82 |
| 4,702,630 | 10/1987 | Igi et al. | 400/82 |
| 4,715,735 | 12/1987 | Kuzuya et al. | 400/82 |
| 4,850,725 | 7/1989 | Walker et al. . | |

FOREIGN PATENT DOCUMENTS 2033304 5/1980 United Kingdom ..... 101/93.11

*Primary Examiner*—Eugene H. Eickholt

*Attorney, Agent, or Firm*—Wilbert Hawk, Jr.; Albert L. Sessler, Jr.

[57] ABSTRACT

A piggyback recorder for use in a printer terminal having a first recorder for printing a first set of data on a document, such as a receipt document. The piggyback recorder is detachably mounted piggyback onto the first recorder, thereby providing a second recorder to the terminal for printing a second set of data on the document. The piggyback recorder comprises a piggyback print member which is capable of printing the second set of data, a mounting member for mounting the piggyback print member directly onto a first print member of the first recorder, a piggyback platen, a second mounting member for mounting the piggyback platen directly onto a first platen of the piggyback recorder, and a solenoid for providing relative movement between the piggyback print member and the piggyback platen. After the piggyback recorder is mounted on the first recorder, the controller can energize the solenoid to cause the piggyback platen to impact the piggyback print member, thereby effecting the printing of the second set of data on the document when the document is located in a printing position between the piggyback print member and piggyback platen.

14 Claims, 7 Drawing Sheets

PIGGYBACK RECORDER FOR ADDING SECOND RECORDER TO A PRINTER TERMINAL

BACKGROUND OF THE INVENTION

1. Field of the Invention.

This invention relates to a piggyback recorder, and more particularly, to a piggyback recorder which can be optionally added to a printer terminal having a first recorder located therein in order to provide a second recorder to the printer terminal.

2. Description of Related Art.

In the field of printer terminals, the typical printer terminal includes a recorder which includes a print member which coacts with a platen to print a first set of data on a document, such as a sales receipt. A typical printer terminal is disclosed in U.S. Pat. No. 4,850,725, issued on July 25, 1989 to A. H. Walker et al., which is assigned to the same assignee as the present invention and which is incorporated herein by reference. In that recorder, the print member is a wire matrix printer which is mounted directly onto a carriage. A line of characters is printed on the document by moving the carriage and the first print member across the document in a side-to-side manner, as is well known.

In some circumstances, it may be advantageous to have a printer terminal which has more than one recorder in order to enable the printer terminal to print multiple sets of data on the document. However, it can be difficult to add the second recorder to the printer terminal because, for example, the printer terminal may have a limited amount of space in which the second recorder can be added. In addition, it may be difficult to add the second recorder to prior art printer terminals because these terminals were not originally designed to accommodate the addition of the second recorder.

SUMMARY OF THE INVENTION.

This invention overcomes the problems previously mentioned by providing a piggyback recorder which can be easily added to an existing printer terminal so as to provide another recorder to the printer terminal.

In one aspect, a preferred embodiment of this invention includes: a piggyback recorder which can be optionally added to a terminal having a first recorder located therein in order to provide a second recorder to the terminal, said terminal including a controller for controlling the operation of the terminal, said first recorder comprising: a first platen, a first print member operatively related to the first platen, said first print member being capable of printing a first set of data on a document when the document is located at a printing station between the first print member and the first platen, said first print member also being coupled to the controller, said piggyback recorder comprising, a piggyback print member for printing a second set of data on the document, first mounting means for mounting the piggyback print member onto the first print member, a piggyback platen, second means for mounting the piggyback platen onto the first platen, drive means for providing relative movement between the piggyback print member and the piggyback platen so as to effect the printing of the second set of data on the document when the document is at the printing station, and coupling means for coupling the drive means to the controller.

In another aspect, a preferred embodiment of this invention includes: a printer terminal having a print station, a first recorder mounted at the print station, and a piggyback recorder optionally added to the first recorder to provide a second recorder at the print station, said printer terminal comprising: a housing, a controller for controlling the operation of the printer terminal, said first recorder comprising: a carriage member, traversing means coupled to the controller for moving the carriage member along the print station, a first platen, first securing means for securing the first platen to the housing, a first print member for printing a first set of data on a document located at a printing position between the first platen and the first print member, said first print member being coupled to the controller, and second securing means for securing the first print member onto the carriage member, said piggyback recorder comprising, a piggyback print member for printing a second set of data on the document, first mounting means for mounting the piggyback print member on the first print member, a piggyback platen, second mounting means for mounting the piggyback platen onto the first platen, drive means for providing relative movement between the piggyback print member and the piggyback platen so as to effect the printing of the second set of data on the document when the document is at the printing position, and coupling means for coupling the drive means to the controller.

An object of this invention is to provide a printer terminal which can be enhanced by adding a second recorder thereto in addition to a first recorder already located in the printer terminal.

Another object of this invention is to provide a piggyback recorder which can be easily mounted in a limited amount of space onto an existing recorder in the printer terminal.

Another object of this invention is to provide a recorder which can be mounted piggyback on the first recorder, thereby providing a second recorder to the printer terminal for printing a second set of data on the document.

An advantage of this invention is that it is easy and inexpensive to manufacture.

Another advantage of this invention is that it enables the printer terminal to quickly print a fixed set of data on the document.

Another advantage of this invention is that it enables a piggyback printer to be mounted directly to the first print member on the carriage, without overloading the traversing means which moves the carriage across the print station.

These objects and advantages, along with others, will become apparent from a reading of the following drawing, descriptions, and claims.

DESCRIPTION OF THE PREFERRED EMBODIMENT.

Figure 1:
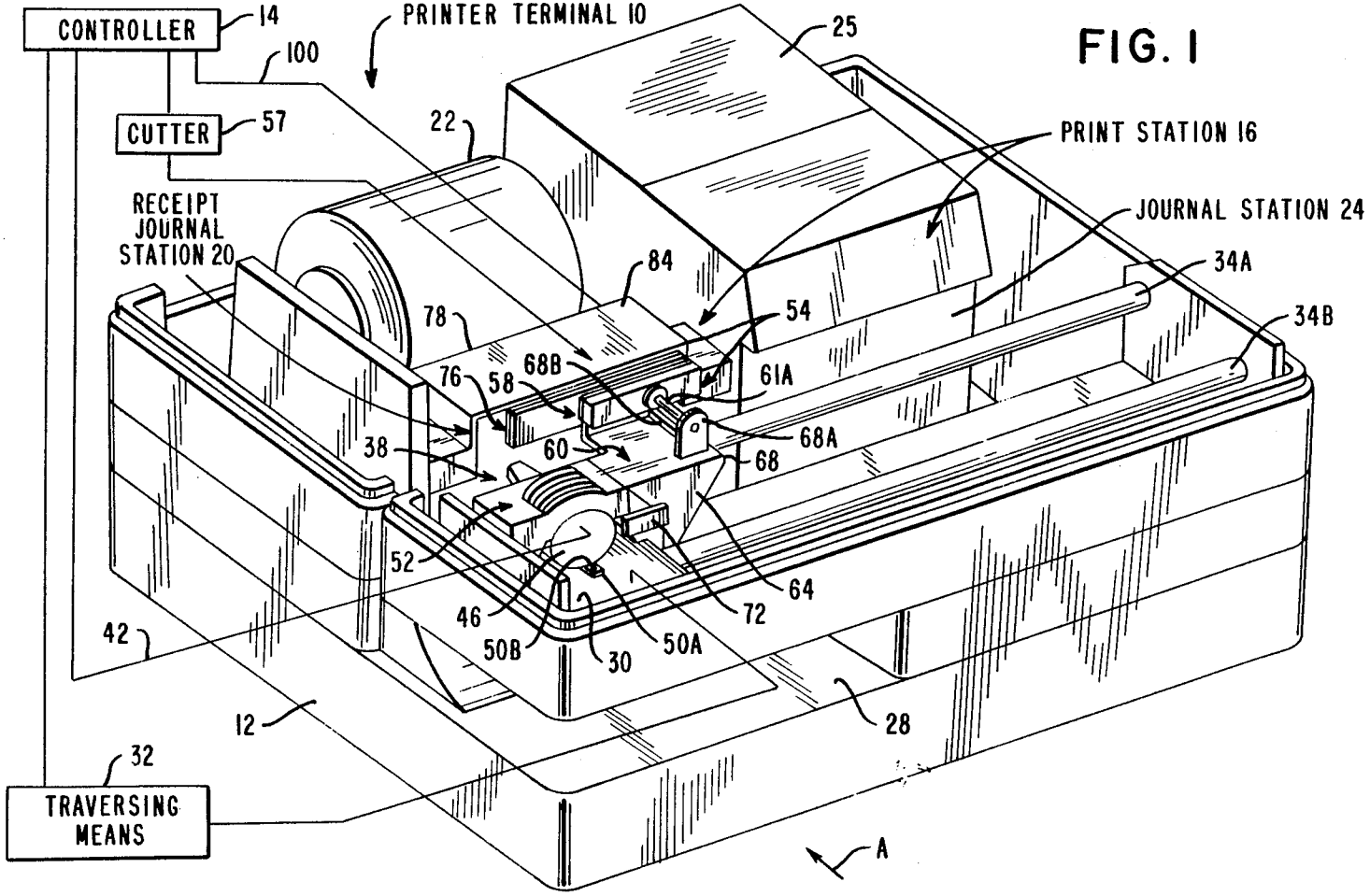
FIG. 1 is a general isometric view of a printer terminal, showing a print station and a piggyback recorder mounted on a first recorder at the print station.

FIG. 1 is a general isometric view of a preferred embodiment of a printer terminal, designated generally as printer terminal 10. The printer terminal 10 comprises a housing 12 and a controller 14 providing electrical signals for controlling the operation of the printer terminal 10. A suitable controller is model #8052, manufactured by Intel Corporation. The printer terminal 10 also includes a print station 16 for printing data on a receipt document 18 (FIG. 2) at a receipt station 20 or on journal paper (not shown) at a journal station 24. In a preferred embodiment, the receipt document 18 (FIG. 2) is supplied from a paper supply roll 22 positioned at the print station 16. The journal paper (not shown) is conventionally supplied from a supply roll (not shown) which is mounted inside the journal housing 25 (FIG. 1). A slot 28 is provided at the left front of the printer terminal (when looking in the direction of arrow A in FIG. 1) in order to print on, for example, a slip (not shown) when the slip is inserted through the slot 28 into the print station 16 from the front of the printer terminal 10.

The print station 16 includes a carriage member 30 which is coupled to traversing means 32 for traversing the carriage member 30 in a side-to-side manner across the print station 16 and the journal station 24. The traversing means 32 includes the support rods 34A and 34B, respectively, which are conventionally secured to the housing 12. The carriage member 30 is slidably mounted directly onto the support rods 34A and 34B by any suitable means, such as circular bushings 36. The traversing means 32 also includes a document drive motor (not shown) which is coupled to the controller 14. The document drive motor is coupled to the carriage member 30 by a timing belt and pulleys (not shown). The controller 14 energizes the document drive motor to move the carriage 30 across the print station 16 in a side-to-side manner so as to effect printing at either the receipt station 20 or the journal station 24 (FIG. 1).

Figure 2:
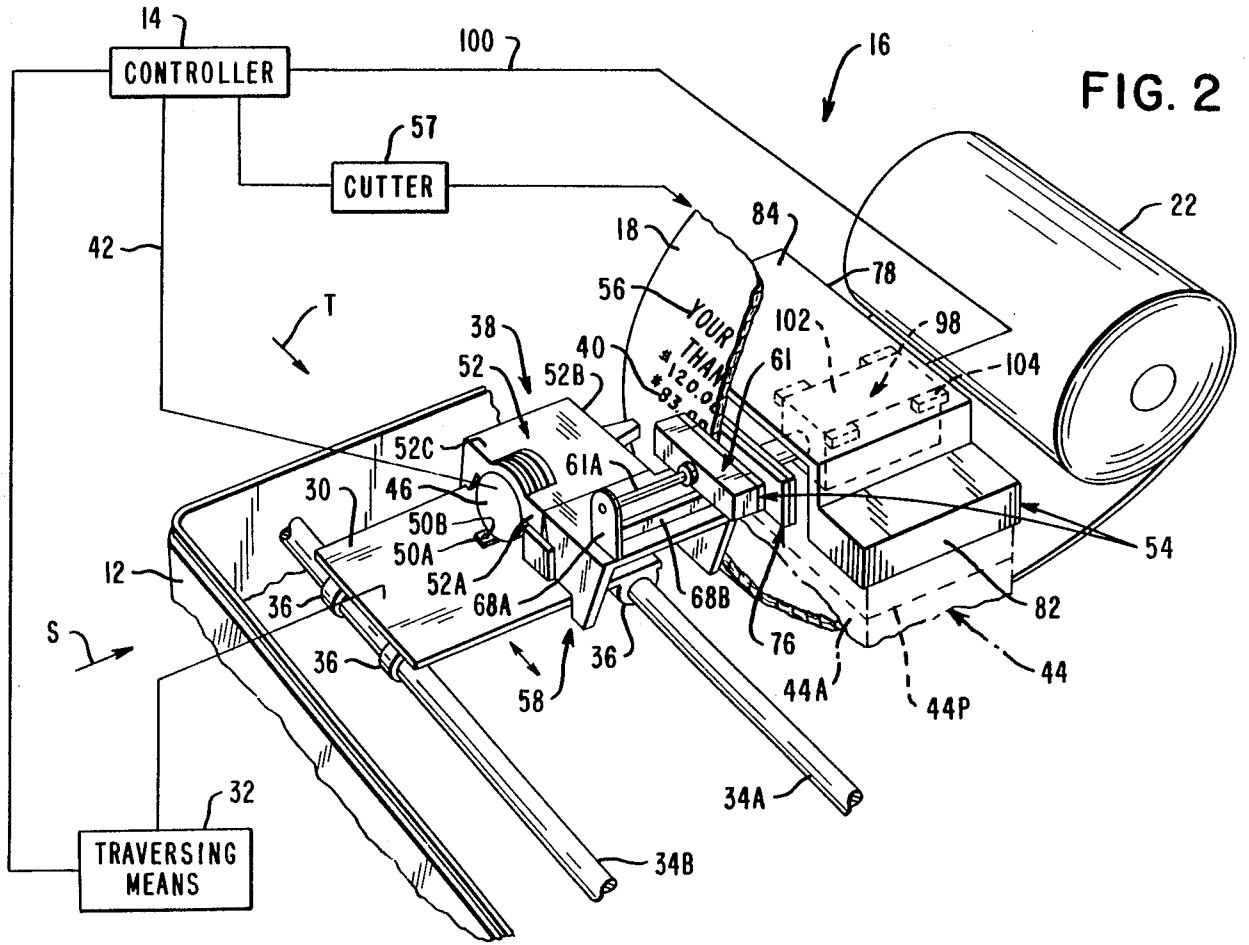
FIG. 2 is a fragmentary isometric view of a portion of the printer terminal shown in FIG. 1, showing more details of the piggyback recorder and also showing a receipt document with first and second sets of data printed thereon.
Figure 3:
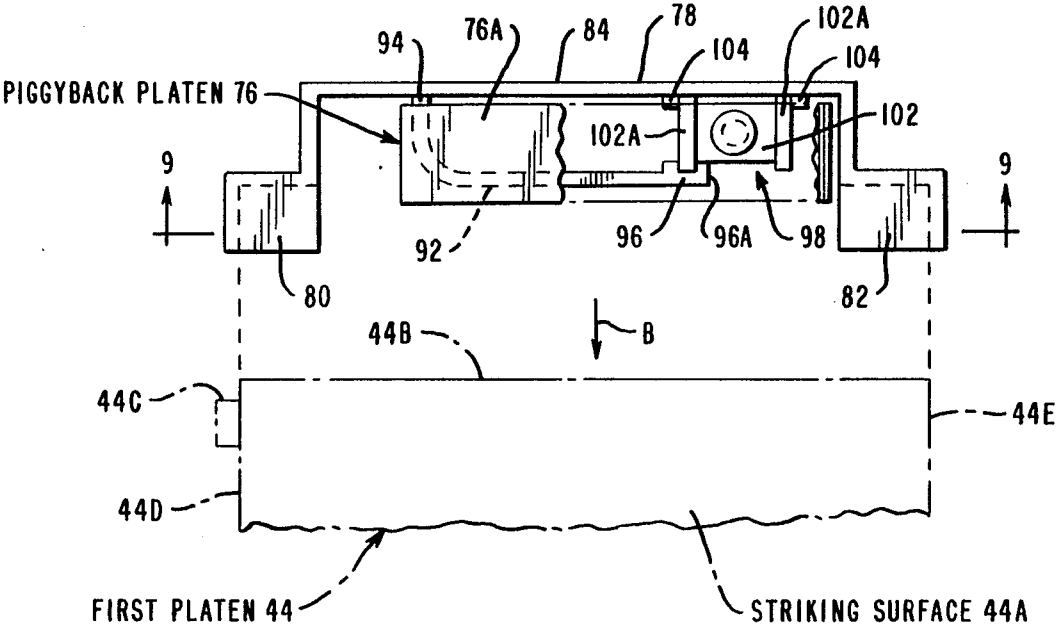
FIG. 3 is a front view of a piggyback platen (shown in solid outline) associated with the piggyback recorder shown in FIG. 2, with this view being taken from the general direction of arrow S in FIG. 2 to show how the piggyback platen is positioned above a first platen (shown in dashed outline) associated with the first recorder prior to mounting the piggyback platen on the first platen.

As best shown in FIGS. 1 and 2, the printer terminal 10 includes a first recorder 38 which is located at the print station 16. The function of the first recorder 38 is to print a first set of data 40 on the receipt document 18 or the journal paper (not shown) at the receipt station 20 (FIG. 1) or journal station 24, respectively. The first recorder 38 includes a first print member 46 (FIG. 2) and a first platen 44. The first print member 46 is coupled to the controller 14 by conductor 42. The first recorder 38 also includes a first securing means for securing the first platen 44 to the housing 12. The first securing means can be any suitable fasteners, such as screws (not shown). As best shown in FIG. 3, the first platen 44 has a striking surface 44A, a top surface 44B, first and second sides 44D and 44E, respectively, and a cylindrical projection 44C which extends away from the first side 44D. The purpose of the top surface 44B and cylindrical projection 44C will be described later herein.

Figure 4:
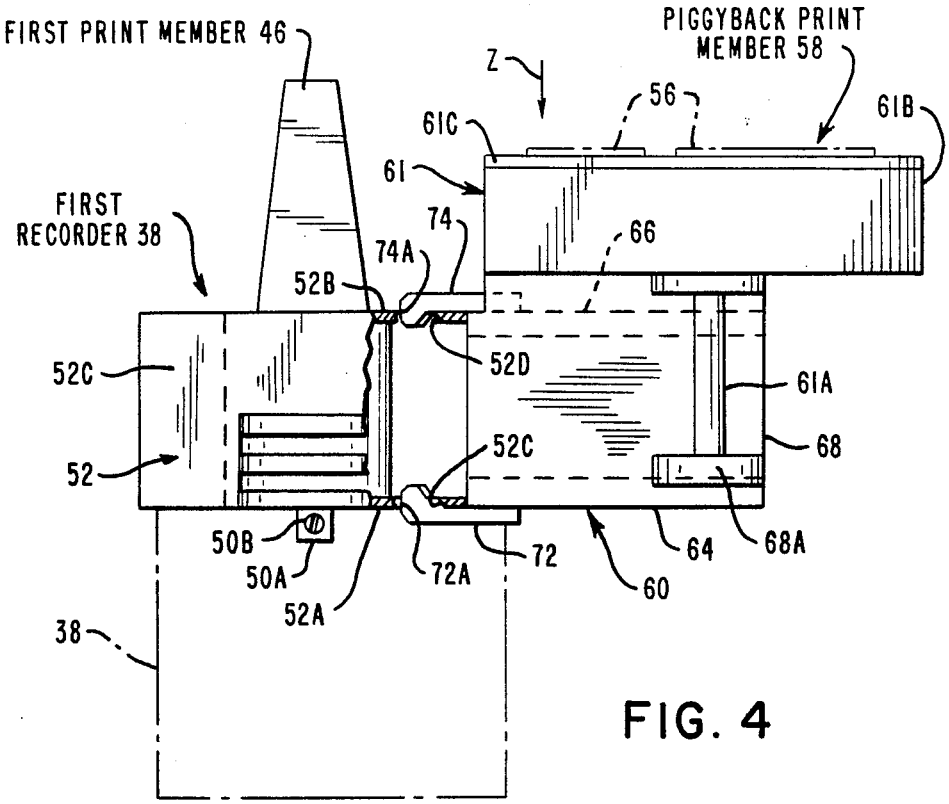
FIG. 4 is a top view of a piggyback printer, showing the piggyback print member in a mounted position on a first print member associated with the first recorder and also showing first mounting means including first and second resilient detents.

The first print member 46 coacts with the striking surface 44A of the first platen 44 to print the first set of data 40 on the receipt document 18 when the receipt document 18 is located at a printing position between the first platen 44 and the first print member 46. A second securing means secures the first print member 46 to the carriage member 30. The second securing means includes a flange 50A and a screw 50B, as best shown in FIG. 4. In a preferred embodiment, the first print member 46 includes a 7-wire wire matrix printer, such as model #DH-90S-008, manufactured by Seiko Epson Corporation. The first print member 46 also includes a heat sink 52 which is mounted by suitable fasteners (not shown) directly over the first print member 46. The purpose of the heat sink 52 is to dissipate the heat generated by the first print member 46. As best shown in FIG. 4, the heat sink 52 includes first and second opposed surfaces 52A and 52B, respectively, which meet in a joining surface 52C.

As mentioned previously herein, the printer terminal 10 includes the first recorder 38 which is located at the print station 16. In a preferred embodiment, a piggyback recorder 54 (FIGS. 1 and 2) can be optionally added to the printer terminal 10 in order to provide a second recorder at the print station 16. The piggyback recorder 54 enables the printer terminal 10 to print a second set of data 56 (FIGS. 2 and 7) on the receipt document 18 (FIG. 2) prior to the receipt document 18 being separated from the supply roll 22 by a paper cutter 57 (FIGS. 1 and 2). The piggyback recorder 54 includes a piggyback print member 58 (FIGS. 1, 2, 4, 5, 6, 7, and 8) and a piggyback platen 76 (FIGS. 1, 2, 3, 9, 10, and 11). In a preferred embodiment, the piggyback print member 58 includes a self-inking electro 61, as best viewed in FIG. 5. The self-inking electro 61 includes a support shaft 61A which is secured to an ink well 61B.

The ink well 61B includes a face layer 61C (FIGS. 4, 5, 7, and 8) which is conventionally secured thereto. The face layer 61C has the second set of data 56 embossed thereon, as best shown in FIGS. 4, 5, 7, and 8.

Figure 5:
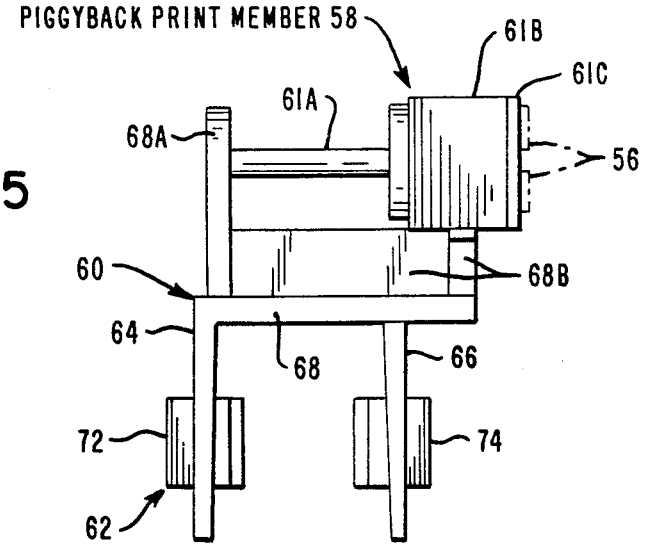
FIG. 5 is a side view of the piggyback printer, taken from the direction of arrow X in FIG. 4, showing a self-inking electro and first and second support members for supporting the self-inking electro.
Figure 6:
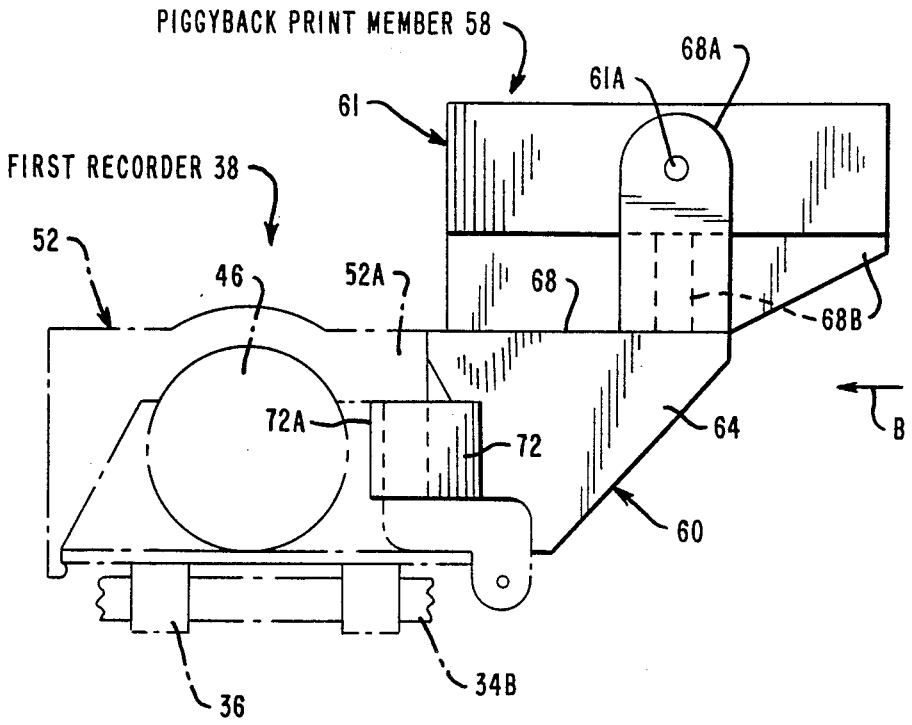
FIG. 6 is a rear view of the piggyback printer, taken from the direction of arrow S in FIG. 2, showing a preferred direction (indicated by arrow B in FIG. 6) in which to move the piggyback printer in order to effect mounting the piggyback printer on the first print member.
Figure 7:
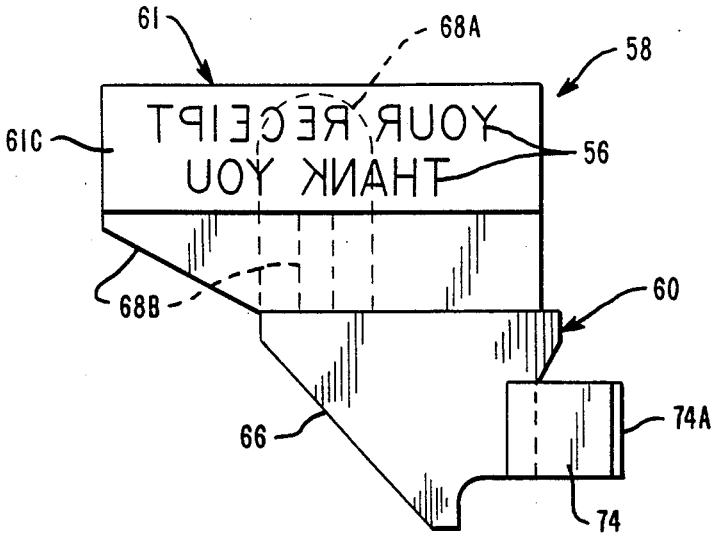
FIG. 7 is a front view of the piggyback printer, taken from the direction of arrow Z in FIG. 4, showing the self-inking electro with a first and second set of data embossed thereon and also showing a support member for supporting the face of the self-inking electro.

The piggyback recorder 54 also includes a first mounting means 60 (FIG. 5) for detachably mounting the piggyback print member 58 onto the first print member 46. As shown in FIG. 5, the first mounting means 60 includes a generally U-shaped member 62 having a first leg portion 64, a second leg portion 66, and a joining portion 68 joining the first and second leg portions 64 and 66. The joining portion 68 includes first and second support members 68A and 68B which extend away from the joining portion 68 and which support the piggyback print member 58, as shown in FIGS. 5 and 6. The first support member 68A receives the support shaft 61A and secures the self-inking electro 61 to the joining portion 68. The support shaft 61A could include, for example, a spring armature (not shown) which enables the self-inking electro 61 to accommodate a misaligned piggyback platen 76 so that even pressure will be applied across the face 61C of the self-inking electro 61 when the piggyback platen 76 is forced thereagainst. The second support member 68B supports the ink well 61B and face layer 61C of the self-inking electro 61 slightly above the joining portion 68, as best shown in FIGS. 5 and 7.

Figure 8:
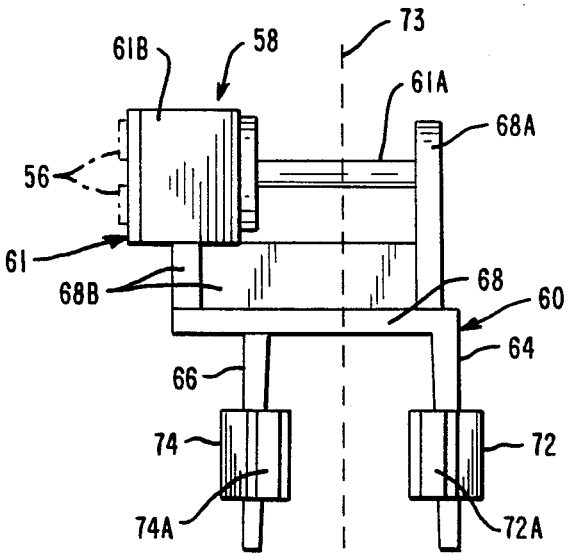
FIG. 8 is a side view of the piggyback printer, taken from the direction of arrow T in FIG. 2, showing the first and second resilient detents and also showing beveled ends of the first and second resilient detents.

The first and second leg portions 64 and 66 include first and second resilient fingers or detents 72 and 74, respectively. The first and second detents 72 and 74 are generally planar and extend away from the first and second leg portions 64 and 66, respectively, as best shown in FIGS. 4, 6, 7, and 8. The first and second detents 72 and 74 are biased towards each other and towards an imaginary plane, shown by dashed line 72 in FIG. 8, to facilitate mounting the piggyback recorder 54, including the associated print member 58, in a mounted position on the first print member 46. The first and second detents 72 and 74 include ends 72A and 74A, respectively, which are angled or beveled inwardly, as best shown in FIGS. 4 and 8. The beveled ends 72A and 74A further facilitate mounting and dismounting the piggyback print member 58 onto and from, respectively, the first print member 46. The heat sink 52 has first and second openings 52C and 52D, respectively, for receiving the first and second detents 72 and 74. When it is desired to mount the piggyback print member 58 onto the first print member 46, the piggyback recorder 54 is positioned slightly to the right of the first print member 46 and heat sink 52 so that the first and second leg portions 64 and 66 are operatively aligned with the first and second opposed surfaces 52A and 52B, respectively, of heat sink 52. The piggyback recorder 54 is then slid in the direction of arrow B in FIG. 6 until the resilient detents 72 and 74 "snap" onto the heat sink 52. The use and operation of the piggyback print member 46 will be described later herein.

Figure 10:
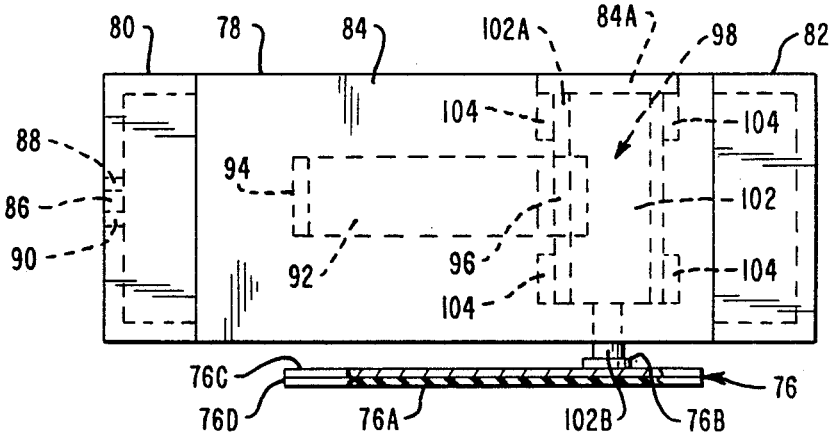
FIG. 10 is a top view of the piggyback platen shown in FIG. 2.
Figure 11:
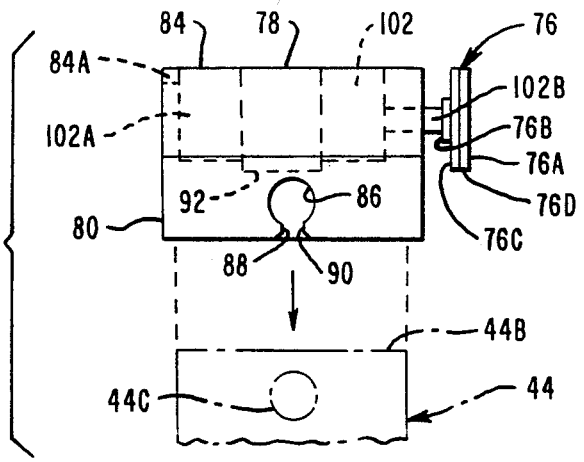
FIG. 11 is a side view of the piggyback platen, taken in the direction of arrow T in FIG. 2, showing more details of the hole and also showing a cylindrical projection which projects from the first platen and which coacts with the hole to retain the piggyback platen in a mounted position on the first platen.

The piggyback recorder 54 includes the piggyback platen 76 which is mounted in opposed relationship with the associated piggyback print member 58 at the print station 16, as best shown in FIGS. 1 and 2. FIG. 3 is a front view of a piggyback platen 76 (shown in solid outline) associated with the piggyback recorder 54 shown in FIG. 2, with this view being taken from the general direction of arrow S in FIG. 2 to show how the piggyback platen 76 is positioned above the first platen 44 (shown in dashed outline) associated with the first recorder 54 prior to mounting the piggyback platen 76 on the first platen 44. The piggyback platen 76 (FIGS. 3, 9, and 10) includes a striking face 76A on one side and a threaded hole 76B (FIG. 9) located on a thin rigid support 76C. The function of the threaded hole 76B is to secure the piggyback platen 76 to a solenoid 102, as is described later herein. In a preferred embodiment, a resilient layer 76D having the striking face 76A is secured to the thin rigid support 76C. The resilient layer 76D is conventionally fastened directly to the rigid support 76C, and it enables the piggyback recorder 54 to better effect the printing of the second set of data 56 on the document 18. The piggyback recorder 54 includes a second mounting means 78 for detachably mounting the piggyback platen 76 onto the first platen 44, as best shown in FIG. 2. The second mounting means 78 includes first and second frame portions 80 and 82 (FIGS. 9 and 10), respectively, and a connecting portion 84 for connecting the first and second frame portions 80 and 82 in an opposed relationship. As indicated generally by the dashed outline 85 in FIG. 9, when the first and second frame portions 80 and 82 are connected together in an opposed relationship, a generally rectangular frame or area is formed. The second mounting means 78 has an inner perimeter (shown by dashed rectangle 85 in FIG. 9) which is complementary in shape to an outer perimeter (shown only partially by a dashed line 44-P in FIG. 2) of the first platen 44 in order to enable the second means 78 to be moved downwardly, as viewed in FIG. 2, and thereby mounted on the first platen 44. The generally rectangular frame or area 85 complements the shape of the top surface 44B (FIG. 3) of the first platen 44 and enables the piggyback platen 76 to be detachably mounted directly onto the top surface 44B of the first platen 44. As best shown in FIG. 11, the first frame portion 80 includes a hole 86 which forms first and second sides 88 and 90, respectively. The first and second sides 88 and 90 can be biased away from each other to facilitate mounting the first frame portion 80 onto the cylindrical projection 44C (FIGS. 3 and 11) of the first platen 44 when the piggyback platen 76 is mounted on the first platen 44. The hole 86 and cylindrical projection 44C ensure proper orientation of the piggyback platen 76 when the piggyback platen 76 is mounted on the first platen 44. After the hole 86 is mounted onto the cylindrical projection 44C, the first and second sides 88 and 90 return to an unbiased position, thereby retaining the piggyback platen 72 on the first platen 38.

The connecting portion 84 of the second mounting means 78 has a resilient L-shaped member 92 depending therefrom, as best shown in FIG. 3. The L-shaped member 92 has a first end 94 which is secured to the connecting portion 84. A second end 96 of the L-shaped member 92 includes a U-shaped channel 96A. In the embodiment being described, the second end 96 of the L-shaped member 92 can be resiliently biased towards and away from the connecting portion 84. The function of the L-shaped member 92 will be described later herein.

Figure 9:
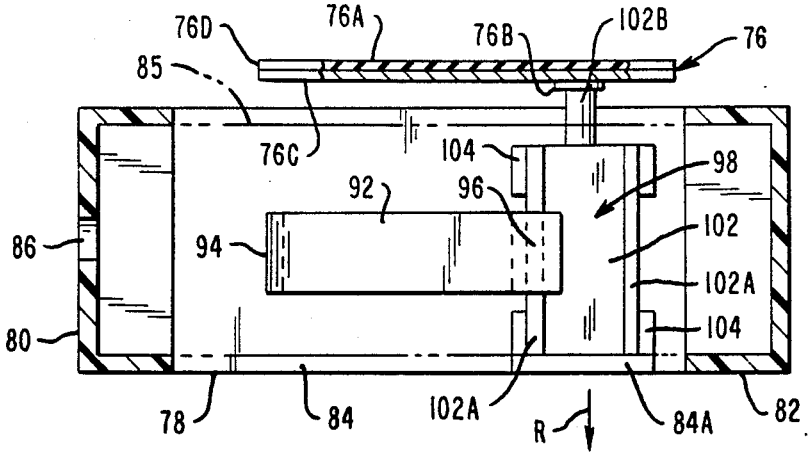
FIG. 9 is a sectional view, taken along the line 9—9 in FIG. 3, of the piggyback platen, showing first and second frame portions which form a generally rectangular area or frame and also showing a drive means.

The piggyback recorder 54 also includes a drive means 98 (FIGS. 9 and 10) for providing relative movement between the piggyback print member 58 and the piggyback platen 76. In a preferred embodiment, the drive means 98 is located on the same side of the print station 16 as the piggyback platen 76. The drive means 98 is coupled to the controller 14 by conductor 100. The drive means 98 includes a solenoid 102 having a frame 102A (FIGS. 3 and 9) and an armature 102B (FIGS. 9, 10 and 11). In a preferred embodiment, the armature 102B has a threaded end (not shown) which is threaded into the threaded hole 76B of the piggyback platen 76, thereby securing the piggyback platen 76 to the armature 102B. The solenoid 102 is secured to the connecting portion 84 of the second mounting means 78 by the resiliently L-shaped member 92. After the frame 102A of the solenoid 102 is positioned in the U-shaped channel 96A on the second end 96 of the L-shaped member 92, as shown in FIG. 3, the L-shaped member 92 forces the solenoid 102 against the connecting portion 84, thereby retaining the solenoid 102 in a mounted position. In this regard, the connecting portion 84 of the second mounting means 78 also includes a plurality of guides 104 (FIGS. 3, 9, and 10) which provide a support frame which surrounds the perimeter of the frame 102A, thereby preventing unwanted movement of the solenoid 102. The connecting portion 84 also includes a lip or flange 84A (FIGS. 9, 10, and 11) which prevents unwanted movement of the solenoid 102 in the direction of arrow R in FIG. 9.

The operation of the piggyback recorder 54 will now be described. As mentioned previously herein, the piggyback recorder 54 can be optionally added to the printer terminal 10 to provide a second printer to the printer terminal 10, thereby enabling the printer terminal 10 to print the second set of data 56 on the receipt document 18. When it is desired to provide a second printer on the printer terminal 10, the piggyback recorder 54 is mounted on the first recorder 38 and the piggyback print member 58 is detachably secured to the first print member 46, as described previously herein in relation to FIG. 4. The traversing means 32 can move the carriage member 30 along the print station 16 so that the first print member 46 (FIG. 2) can print the first set of data 40 on either the receipt document 18 or the journal paper (not shown). When it is desired to print the second set of data 56 on the receipt document 18, the controller 14 activates the traversing means 32 to move the carriage member 30 towards the left side of the printer terminal 10, as viewed in FIG. 1. This movement positions the piggyback print member 58 in operative relationship with the piggyback platen 76. The controller 14 then activates a document drive motor (not shown) to move the receipt document 18 upwardly, as viewed in FIG. 2, into the print station 16. The controller 14 then energizes the solenoid 102 to force the piggyback platen 76 and the document 18 against the self-inking electro 61 of the piggyback print member 58, thereby effecting the printing of the second set of data 56 on the receipt document 18.

In a preferred embodiment, the first and second mounting means 60 and 78 are each a one piece construction molded from plastic.

While the invention has been described with reference to a specific embodiment, this description is merely illustrative, and it is not to be construed as limiting the scope of the invention. For example, the drive means 98 (FIG. 3) could be situated so that a stationary piggyback print member (like 58) impacts against a piggyback platen (like 76) in order to effect the printing of the second set of data. In addition, a thermal printer (not shown) could be substituted in place of the self-inking electro 61 and operatively coupled to the controller 14 which would enable the piggyback print member (like 56) to easily change the second set of data. Various other modifications and changes may occur to those skilled in the art without departing from the spirit and scope of the invention as defined by the appended claims.

What is claimed is:

1. A piggyback recorder which can be optionally added to a terminal having a first recorder located therein in order to provide a second recorder to the terminal, said terminal including a controller for controlling the operation of the terminal, said first recorder comprising:

a first platen;

a first print member operatively related to said first platen, said first print member being capable of printing a first set of data on a document when the document is located at a printing station between said first print member and said first platen, said first print member also being coupled to the controller;

said piggyback recorder comprising;

a piggyback print member for printing a second set of data on the document;

first mounting means for mounting said piggyback print member onto the first print member;

a piggyback platen;

second means for mounting said piggyback platen onto the first platen;

drive means for providing relative movement between said piggyback print member and said piggyback platen so as to effect the printing of the second set of data on the document when the document is at said printing station; and coupling means for coupling said drive means to the controller.

2. The piggyback recorder as claimed in claim 1 in which said first mounting means includes a generally U-shaped member, said generally U-shaped member having a first leg portion, a second leg portion, and a joining portion joining said first and second leg portions, said first and second leg portions including first and second detents which are resiliently biased towards each other;

said first print member having first and second openings therein to receive said first and second detents, respectively, to detachably mount the piggyback print member on said first print member.

3. The piggyback recorder as claimed in claim 2 in which said piggyback print member includes a support rod extending therefrom;

said joining portion further including a support member having an aperture therein for receiving said support rod in order to secure said piggyback print member to said generally U-shaped member.

4. The piggyback recorder as claimed in claim 1 in which said piggyback print member includes a self-inking electro.

5. The piggyback recorder as claimed in claim 1 in which said first platen has an external perimeter and in which said second mounting means further comprises:

first and second frame portions;

a connecting portion for connecting said first and second frame portions in spaced relationship to form an internal perimeter having a shape which complements the shape of said external perimeter of the first platen to enable said piggyback platen to be slidably mounted on said first platen and to facilitate retaining said piggyback platen in a mounted position on said first platen.

6. The piggyback recorder as claimed in claim 5 in which said drive means includes a solenoid having a frame and a plunger;

said piggyback platen being secured to said plunger; and said connecting portion including an L-shaped member secured thereto for receiving said frame of said solenoid and for securing the solenoid to said connecting portion.

7. The piggyback recorder as claimed in claim 1 in which said first print member includes a wire matrix printer having a heat sink secured thereto and in which said piggyback print member is detachably mounted on said heat sink.

8. A printer terminal having a print station, a first recorder mounted at said print station, and a piggyback recorder optionally added to said first recorder to provide a second recorder at said print station, said printer terminal comprising:

a housing;

a controller for controlling the operation of the printer terminal;

said first recorder comprising:

a carriage member;

traversing means coupled to said controller for moving said carriage member along said print station;

a first platen;

first securing means for securing said first platen to said housing;

a first print member for printing a first set of data on a document located at a printing position between said first platen and said first print member; said first print member being coupled to the controller; and second securing means for securing said first print member onto said carriage member;

said piggyback recorder comprising;

a second print member for printing a second set of data on the document;

first mounting means for mounting said second print member on said first print member;

a second platen;

second mounting means for mounting said second platen onto said first platen; and drive means for providing relative movement between said second print member and said second platen so as to effect the printing of the second set of data on the document when the document is at said printing position.

9. The printer terminal as claimed in claim 8 in which said first mounting means includes a generally U-shaped member, said generally U-shaped member having a first leg portion, a second leg portion, and a joining portion joining said first and second leg portions, said first and second leg portions including first and second detents which can be biased towards each other;

said first print member having first and second openings therein to receive said first and second detents, respectively, to detachably mount the second print member on said first print member.

10. The printer terminal as claimed in claim 9 in which said second print member includes a support rod extending therefrom;

said joining portion further including a support member upstanding therefrom for receiving said support rod in order to secure said second print member to said generally U-shaped member.

11. The printer terminal as claimed in claim 8 in which said second print member includes a self-inking electro.

12. The printer terminal as claimed in claim 8 in which said first platen has an external perimeter and in which said second mounting means further comprises:

first and second frame portions;

a connecting portion for connecting said first and second frame portions in spaced relationship to form an inner perimeter having a shape which complements the shape of said external perimeter of the first platen to enable said second platen to be detachably mounted onto said first platen and also to facilitate retaining said second platen in a mounted position on said first platen.

13. The printer terminal as claimed in claim 12 in which said drive means includes a solenoid having a frame and a plunger;

said second platen being secured to said plunger; and said connecting portion including an L-shaped member secured thereto for receiving said frame of said solenoid and for securing the solenoid to said connecting portion.

14. The printer terminal as claimed in claim 8 in which said first print member includes a wire matrix printer having a heat sink secured thereto and in which said second print member is detachably mounted on said heat sink.

* * * * *